United States Patent [19]

Fender

[11] Patent Number: 4,803,906

[45] Date of Patent: Feb. 14, 1989

[54] NECK FOR GUITAR

[76] Inventor: C. Leo Fender, 1510 Dana Pl., Fullerton, Calif. 92635

[21] Appl. No.: 907,238

[22] Filed: Sep. 15, 1986

[51] Int. Cl.[4] ..... G10D 1/08

[52] U.S. Cl. ..... 84/293; 84/267

[58] Field of Search ..... 84/267, 275, 293, 290, 84/291

[56] References Cited

U.S. PATENT DOCUMENTS

| | | | |
|---|---|---|---|
| 3,396,621 | 8/1968 | Pycus | 84/293 |
| 3,439,570 | 4/1969 | Lee | 84/293 |
| 3,911,778 | 10/1975 | Martin | 84/291 X |
| 4,538,497 | 9/1985 | Smith | 84/291 |

FOREIGN PATENT DOCUMENTS

| | | | |
|---|---|---|---|
| 2045993 | 11/1980 | United Kingdom | 84/293 |

*Primary Examiner*—Benjamin R. Fuller

*Attorney, Agent, or Firm*—Spensley Horn Jubas & Lubitz

[57] ABSTRACT

An electric guitar having a body and a neck that supports a fret board is provided with a neck that removably fits into a slot in the body. The guitar neck is constructed so that the portion of the mounting portion of the neck that fits into the body slot is of constant dimension, regardless of the fret board width, while the remaining portion of the mounting end is as wide as the fret board.

7 Claims, 1 Drawing Sheet

WF
"WS"
"L"
"D"

NECK FOR GUITAR

BACKGROUND OF THE INVENTION

1. Field of the Invention

This invention relates to guitar necks and, more particularly, to interchangeable necks having fret boards of varying sizes.

2. Description of the Related Art

The electric guitar, incorporating electrical transmission of the sounds emitted by the guitar's strings when plucked or strummed, is in wide use today. Different styles of music, such as rock and country, may utilize different techniques in playing and can necessitate guitars having fret boards of varying width and curvature. Furthermore, even within a particular style of music, different performers will have different styles of playing and individual performers may desire a selection of guitars having various neck and fret board combinations. It is not uncommon for performers to have at their disposal many different electric guitars satisfying their stylistic and esthetic requirements. These various guitars will likely be of differing configuration, as to the shape of the guitar body and the shape and size of the fret board and guitar neck.

Presently, electric guitars are produced in various guitar body and guitar neck configurations, the body and neck being individually formed and joined together during the production process. Typically, the guitar neck is fitted into a slot in the guitar body and secured by means of screws, the slot size being dependent upon the size of the particular neck. Performers who desire various guitar neck and guitar body configurations must purchase a separate electric guitar for each configuration desired.

It is an object of the present invention to provide an electric guitar having an easily replaceable neck and, in particular, to provide a guitar neck whose mounting surfaces contacting the guitar body slot are of standardized dimensions, regardless of the size of the fret board or neck. In this way, the present invention allows the performer to change the guitar neck without purchasing an additional guitar, and thereby provides the performer with greatly increased flexibility at minimal cost.

SUMMARY OF THE INVENTION

The present invention provides an electric guitar with an easily interchangeable neck, the guitar body of the present invention being provided with a slot for receiving one end of the guitar neck and the end of the guitar neck to be fitted into the body slot being of a standardized size, regardless of the varying width and configuration of the rest of the guitar neck. In this way, a single guitar body can accommodate guitar neck-fret board combinations of different configurations.

Prior to the present invention, anyone desiring the flexibility of different width fret boards was forced to purchase a different electric guitar for each different width of fret board desired. Anyone desiring a variety of fret board sizes and designs for stylistic or esthetic reasons was forced to purchase a different guitar for each such design. With the present invention, one purchases a single guitar and then separately purchases additional guitar necks having the desired fret board sizes and styles.

The guitar neck currently in use typically is rectangular in cross section at the point of attachment to the guitar body (the mounting end), and fits into a body slot provided for attachment. In contrast, the portion of the guitar neck of the present invention in contact with the slot will be of a fixed height, depth, and width. The portion of the guitar neck mounting end extending beyond the slot and above the body of the guitar broadens outward as the fret board is approached, so as to extend to a width greater than that of the body recess and equal to that of the fret board.

The novel features that are believed to be characteristic of the present invention, together with further objectives and advantages thereof, will be better understood from the description considered in connection with the accompanying drawings in which the presently preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENTS

Figures 1, 2, 3, 4:
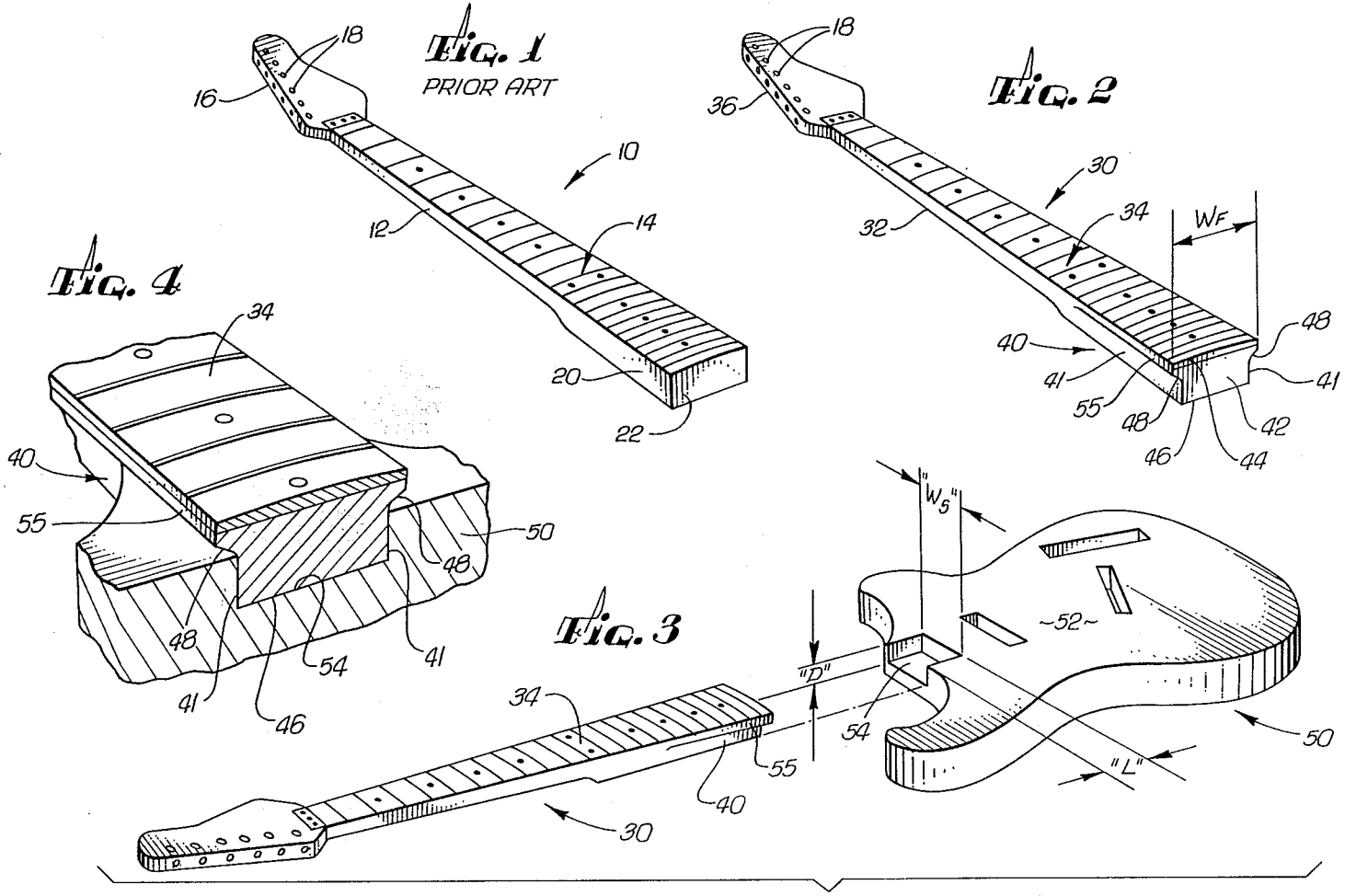
FIG. 1 PRIOR ART
FIG. 1 is a perspective view of a prior art guitar neck.
FIG. 2 is a perspective view of a guitar neck in accordance with the present invention.
FIG. 3 is a perspective view of a guitar body and guitar neck in accordance with the present invention.
FIG. 4 is a perspective view of the neck and body joint portion of a guitar in accordance with the present invention.

The following description is of the best presently contemplated mode of carrying out the invention. This description is made for the purpose of illustrating the general principles of the invention and is not to be taken in a limiting sense. The scope of the invention is best determined by reference to the appended claims.

FIG. 1 shows a prior art guitar neck 10 comprised of an elongate portion 12 carrying a fret board 14 ona top surface, with a substantially planar head section 16 provided at one end with a plurality of holes 18 into which string posts (not illustrated) may be inserted for securing one end of the guitar strings. At the mounting end 20 of the guitar neck 12 opposite that of the head section 16, and below the fret board 14, the guitar neck is of a substantially rectangular cross-section ending in a blunt end 22. This mounting end 20 of the guitar neck is fit into a slot in a guitar body (not illustrated) and is then securely fastened by means of screws or permanent bonding.

FIG. 2 shows a guitar neck 30 constructed in accordance with the present invention. The guitar neck 30 has an elongate portion 32 supporting a fret board 34 and terminating at one end in a head section 36 provided with a plurality of holes 38 into which guitar string posts (not illustrated) are inserted for anchoring one end of the guitar strings. The mounting end 40 of the guitar neck 32 opposite that of the head section 36 is provided with sides 41 and a blunt, flat end 42 that fits into a guitar body slot. The fret board end portion at the mounting end 40 of the guitar neck is identified at 44 and has a width "$W_F$" (indicated in the drawing) greater than that of the guitar body slot (not illustrated in FIG. 2). The opposite edge 46 of the guitar neck defines the bottom surface of the neck and has a width such that the end of the guitar neck will fit snugly into the guitar body slot. Between the mounting edge 46 and fret board 44 is an extended portion 48 of the guitar neck, forming a ledge upon which the fret board end 44 is mounted.

A guitar body 50 and a guitar neck 30 in accordance with the present invention are illustrated in FIG. 3 and FIG. 4. The mounting end 40 is shaped so as to fit into a guitar body slot 54. The dimensions of the slot 54 are illustrated in FIG. 3 as length "L", depth "D", and width "$W_s$". The depth of the slot is measured from the guitar body top surface 52 into the body. When the mounting end 40 is placed into the slot 54, the extended portion 48 and ledge 55 described in FIG. 2 and the fret board 34 will extend above and beyond slot 54. In this way, a fret board wider than that for which the body was originally designed may be accommodated and a variety of guitar necks having different size fret boards can be attached to a single guitar body.

I claim:

1. An electric guitar having a body, a neck extending from the body, and a fret board of a preselected end width supported by the neck, the body having a slot of predetermined depth, width, and length, the slot width being less than the end width of the fret board, the neck having a mounting end for fitting into the body slot and comprising (a) a blunt end face having width and height dimensions of the same width and depth, respectively, as the body slot, (b) opposed top and bottom surfaces, the bottom surface having the length and width of the body slot, the top surface having a width equal to the end width of the fret board, and (c) opposed side surfaces, the side surfaces having a mounting portion with dimensions at least equal the depth and length of the body slot, a portion of at least one of the side surfaces extending beyond the mounting portion and having a broadened portion that flairs outwardly toward the top surface and fret board.

2. The guitar of claim 1 wherein the broadened portion forms a shoulder supporting the fret board and fitting flush therewith.

3. An electric guitar comprising:

a body with a top surface, bottom surface, and said surface between the top and bottom, having a slot of predetermined length, depth, and width, the body being open on the top surface along the length and width of the slot and open on the side surface along the depth and width of the slot;

a neck having a mounting end for fitting into the body slot, the mounting end having a blunt face, top surface, bottom surface, and side surfaces, the blunt face having a bottom portion of the same width as the body slot and of a height at least equal to the depth of the body slot, the bottom surface being of the same width and of at least equal length as the slot, the side surfaces being of at least the same length as the slot and of greater height than the depth of the slot;

a fret board supported by the top surface of the neck, the fret board being of greater width than the body slot; wherein;

the top surface of the neck is of the same width as the fret board and the side surfaces of the mounting end have an extended portion such that the mounting end is of the same width as the slot for a distance equal to at least the height of the slot and then is broadened outwardly to the top surface of the mounting end.

4. A guitar neck for use with a fret board of a predetermined end width, the neck having a top surface supporting the fret board and a bottom surface, the neck comprising a first end with a mounting portion of predetermined length, width, and height, including the bottom surface of the neck, the width of the mounting portion being less than the end width of the fret board, and a top portion, including the top surface of the neck, for supporting the fret board, the top portion extending outwardly from the mounting portion so that the top surface of the neck is the same width as the end width of the fret board.

5. The guitar neck of claim 4 wherein the end of the fret board is flush with the first end of the neck.

6. The guitar of claim 1 wherein the end of the fret board is flush with the blunt end face.

7. A guitar neck in combination with a fret board wherein:

the fret board has a first end of a preselected width, the neck has a top surface to which the fret board is attached, the neck top surface has a mounting end terminating contiguously with the fret board first end, and the neck has a bottom surface, opposed to the top surface, which has a width that is less than the preselected width of the fret board.

* * * * *